United States Patent [19]

Toyota et al.

[11] Patent Number: 4,982,888

[45] Date of Patent: Jan. 8, 1991

[54] APPARATUS FOR ATTACHING FASTENER ELEMENTS TO A GARMENT

[75] Inventors: Sumio Toyota; Takeshi Arai, both of Toyama, Japan

[73] Assignee: Yoshida Kogyo K.K., Tokyo, Japan

[21] Appl. No.: 375,929

[22] Filed: Jul. 6, 1989

[30] Foreign Application Priority Data

Jul. 8, 1988 [JP] Japan ..... 63-171399

[51] Int. Cl.[5] ..... A41H 37/02

[52] U.S. Cl. ..... 227/18; 227/152; 227/155

[58] Field of Search ..... 227/15, 16, 17, 18, 227/152, 155, 154; 901/6; 414/749; 269/13, 910

[56] References Cited

U.S. PATENT DOCUMENTS

| | | | |
|---|---|---|---|
| 1,114,177 | 10/1914 | Olm | 227/17 |
| 3,265,275 | 8/1966 | Wilson | 227/18 |
| 3,653,293 | 4/1972 | Wallis | 414/749 X |
| 3,756,107 | 9/1973 | Pax et al. | 414/749 X |
| 3,910,420 | 10/1975 | Rich | 414/749 X |
| 4,548,115 | 10/1985 | Martin et al. | 414/749 X |
| 4,789,089 | 12/1988 | Toyota | 227/18 X |
| 4,824,004 | 4/1989 | Hanson | 269/910 X |

FOREIGN PATENT DOCUMENTS 1329084 9/1973 United Kingdom .

*Primary Examiner*—Paul A. Bell
*Assistant Examiner*—Rinaldi Rada
*Attorney, Agent, or Firm*—Hill, Van Santen, Steadman & Simpson

[57] ABSTRACT

An apparatus for attaching fastener elements one at a time to a garment includes a die plate disposed below a punch and having a plurality of dies spaced apart in a first direction. The die plate is slidably movable in the one direction to place the dies successively into alignment with the punch. The die plate is displaceable in a second direction away from the punch in a plane of sliding movement of the die plate. The die plate is pivotally movable in a vertical plane when it is disposed in a position remote from the punch. According to a preferred embodiment, the second direction is perpendicular to the first direction and the die plate is tiltable upwardly as it is displaced in the second direction away from the punch.

7 Claims, 9 Drawing Sheets

APPARATUS FOR ATTACHING FASTENER ELEMENTS TO A GARMENT

BACKGROUND OF THE INVENTION

1. Field of the Invention

The present invention relates to an apparatus for attaching a plurality of fastener elements to the sleeve or pocket portion of a garment, such as a pair of trousers, a skirt or the like, at predetermined intervals.

2. Description of the Prior Art

In a process of attaching a fastener element to a sleeve or pocket portion of a garment, and more particularly when an eye member for hook-and-eye fasteners is to be attached to a waistband of a pair of trousers, the eye member is clenched by a reciprocating punch of a clenching machine against an associated separate back plate which is disposed on a die and placed against the backside of the waistband. One example such clenching machine is disclosed in British Patent No. 1,329,084.

The disclosed clenching machine is so constructed as to attach a pair of eye members simultaneously to a garment such as a pair of trousers. To this end, the clenching machine includes a pair of lower dies, vibratory hoppers for supplying the eye members to the respective lower dies through chutes, a pair of upper dies formed by recesses in the underside of a mandrel member, and back-plate storage magazines from which back plates are supplied through chutes to the respective upper dies. The mandrel member can be displaced in a direction away from a clenching station of the machine so that the mandrel member can readily receive a waistband of the trousers with greater working space available for manipulation of the material. This displacement of the mandrel member is obtained by a displacement mechanism comprising a quadrilateral link mechanism.

The clenching machine of the foregoing construction operates highly efficiently because two eye members are attached at the same time. However, this machine is complicated in construction, large in size and hence occupies a relatively large space for installation thereof. Yet, the known clenching machine is difficult to maintain because a fine adjustment must be done frequently so as to ensure that two eye-element and back-plate pairs are supplied at the same timing and then clenched under the same condition. Furthermore, in order to provide a relatively large space around the mandrel member, the amount of displacement of the mandrel member must be increased by using a quadrilateral link mechanism having relatively long link members. Such a quadrilateral link mechanism is large in height, therefore, the manipulating portion is set at a relatively high position. With this high manipulating position, a high working efficiency of the operator is difficult to expect.

SUMMARY OF THE INVENTION

It is accordingly an object of the present invention to provide an apparatus which is compact and capable of attaching fastener elements one at a time to a garment efficiently with utmost ease.

Another object of the present invention is to provide a fastener attaching apparatus which is simple in construction and easy to maintain.

According to the present invention, an apparatus for attaching fastener elements one at a time to a garment includes a die plate disposed below a vertically movable punch and having a plurality of dies spaced apart in a first direction. The die plate is slidably movable in the first direction to successively place the dies into alignment with the punch. The die plate is displaceable in a second direction away from the punch in a plane of sliding movement of the die plate. The die plate is also pivotally movable in a vertical plane when it is disposed in a position remote from the punch. According to a preferred embodiment of the present invention, the second direction is perpendicular to the first direction and the die plate is tiltable upwardly as it is displaced in the second direction away from the punch.

Many other advantages and features of the present invention will become manifest to those versed in the art upon making reference to the detailed description and the accompanying sheets of drawings in which preferred structural embodiments incorporating the principles of the present invention are shown by way of the illustrative example.

DETAILED DESCRIPTION

Figure 1:
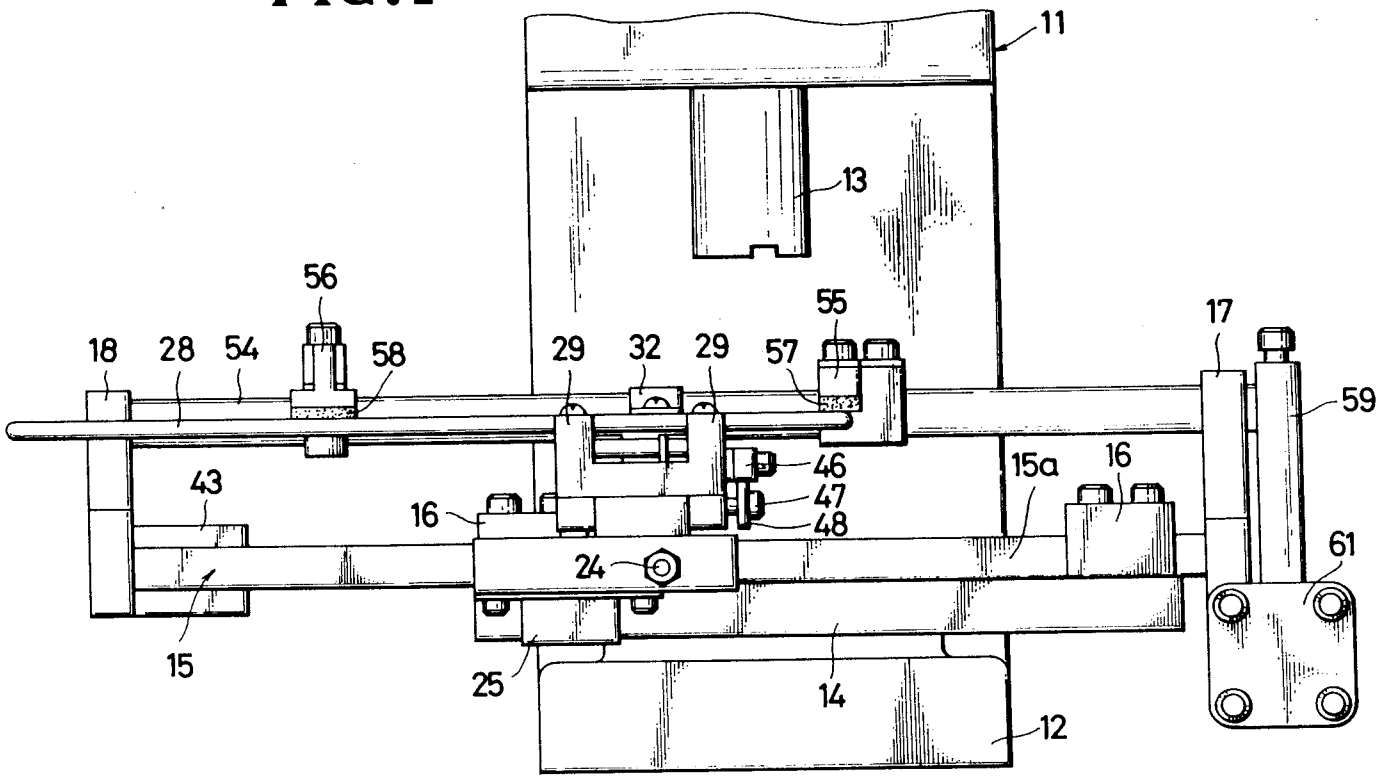
FIG. 1 is a front elevational view of an apparatus for attaching fastener elements to garments according to the present invention.
Figure 5:
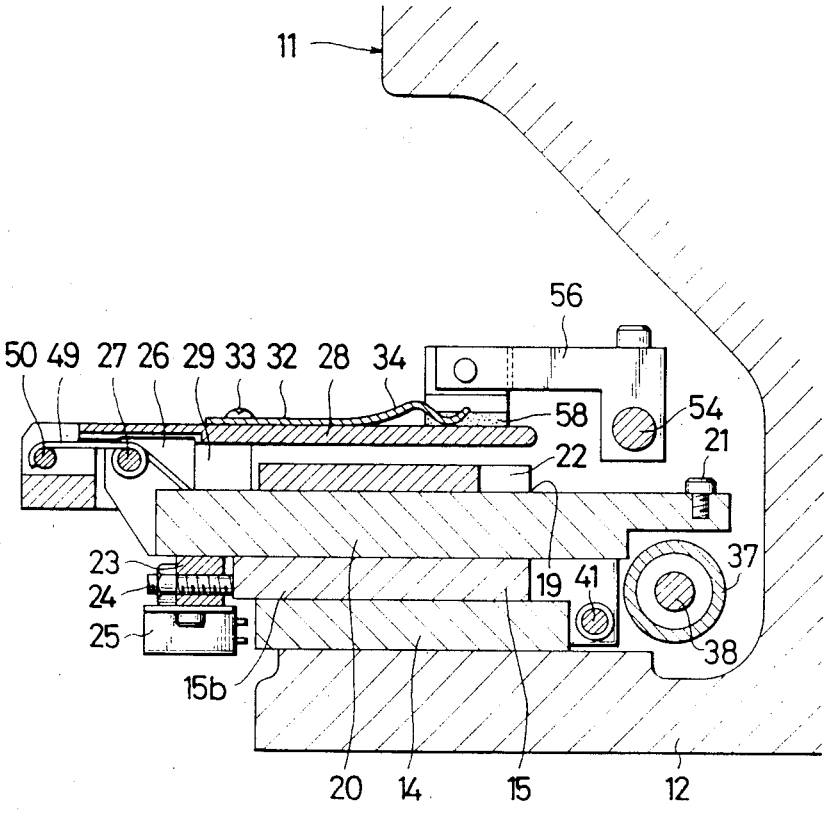
FIG. 5 is a cross-sectional view taken along line V—V in FIG. 2.
Figure 10:
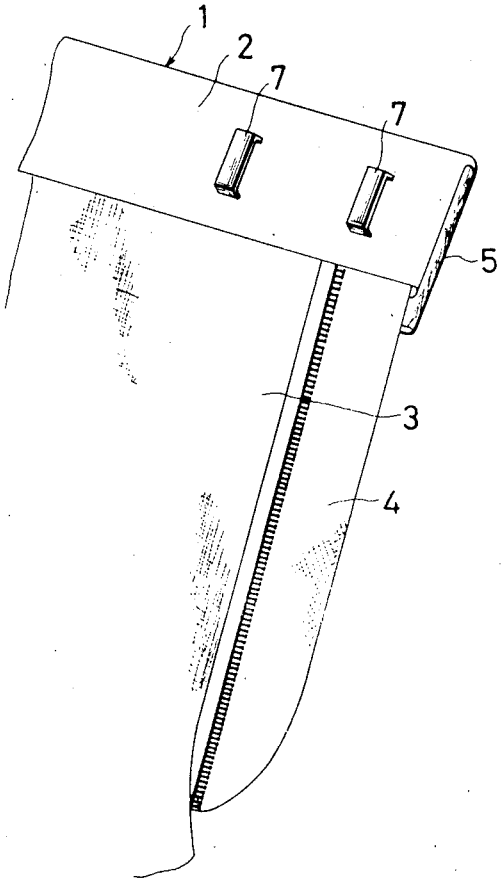
FIG. 10 is a fragmentary perspective view of a trouser body having a waistband to which two eye member for hook-and-eye fasteners are attached.
Figure 11:
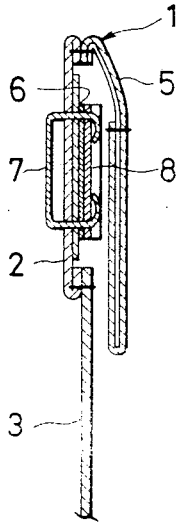
FIG. 11 is a cross-sectional view of one eye member shown in FIG. 10.

The present invention is particularly useful when embodied in a fastener attaching apparatus such as shown in FIGS. 1 and 5, generally indicated by the reference numerals 11. The apparatus 11 is used for attaching two eye members 7 for hook-and-eye fasteners to a waistband 2 of a pair of trousers 1 in laterally spaced relation to one another, as shown in FIGS. 10 and 11. The waistband 2 is stitched to a trouser body 3 and a fly front 4 along their upper edges. The upper edge of the waistband 2 is stitched to the upper edge of a lining cloth 5 so that the waistband 2 and the lining cloth 5 jointly define therebetween a sleeve portion or pocket. The eye member 7 has two prongs which are adapted to be forced through the thickness of the waistband 2 and a stay or inner lining 6 (FIGS, 1 and 11) and to be folded or clenched over against an associated separate back plate 8 positioned against the backside of the stay 6, as shown in FIG. 11.

The fastener attaching apparatus 11, as shown in FIGS. 1 through 5, includes a generally C-shaped frame 12, a punch 13 vertically reciprocably mounted on an upper part of the C-shaped frame 12, a rectangular base plate or table 14, a transverse slide plate 15 slidably mounted on an upper surface of the table 14 and reciprocally movable in a lateral direction of the apparatus 11, and two pairs of confronting guide blocks 16 disposed on the table 14 adjacent to opposite side ends thereof for guiding the transverse slide plate 15.

The transverse slide plate 15 has a generally T shape and includes an elongate rectangular body 15*a* slidably guided by the guide blocks 16, and a lateral projection 15*b* projecting rearwardly from an intermediate portion of the elongate body 15*a*. The elongate body 15*a* is connected at its opposite ends to a pair of side plates 17, 18 extending vertically upwardly. The lateral projection 15*b* has formed therein a downwardly open longitudinal guide groove 19 in which a longitudinal slide plate 20 is slidably received.

The longitudinal slide plate 20 has a first stopper 21 disposed at the front end thereof. When the longitudinal slide plate 20 is retracted or moved rearwardly, the first stopper 21 is fitted in a forwardly open cutout recess 22 formed in an upper wall of the guide groove 19 and engages the upper wall to thereby limit the rearward movement of the longitudinal slide plate 20. The longitudinal slide plate 20 further has a support plate 23 (FIG. 5) disposed on the underside of the longitudinal slide plate 20 adjacent to the rear end thereof. A second stopper in the form of a bolt 24 is threaded horizontally through the support plate 23 and extends in confrontation to the rear end face of the lateral projection 15*b* of the transverse slide plate 15. The bolt 24 is engageable with the rear end face of the lateral projection 15*b* to limit forward movement of the longitudinal slide plate 20. A magnet catch 25 is disposed on the underside of the support plate 23 and attracts the rear end face of the table 14 to thereby hold an advanced position of the longitudinal slide plate 20. A pair of laterally spaced brackets 26, 26 extends upwardly from the rear end of the longitudinal slide plate 20, and a horizontal pivot pin 27 extends between the brackets 26.

The pivot pin 27 extends through a pair of laterally spaced bracket 29, 29 extending downwardly from the underside of a die plate 28 which overlies the longitudinal slide plate 20. Thus, the die plate 28 is pivotally movable about the pivot pin 27 in a vertical plane.

Figure 2:
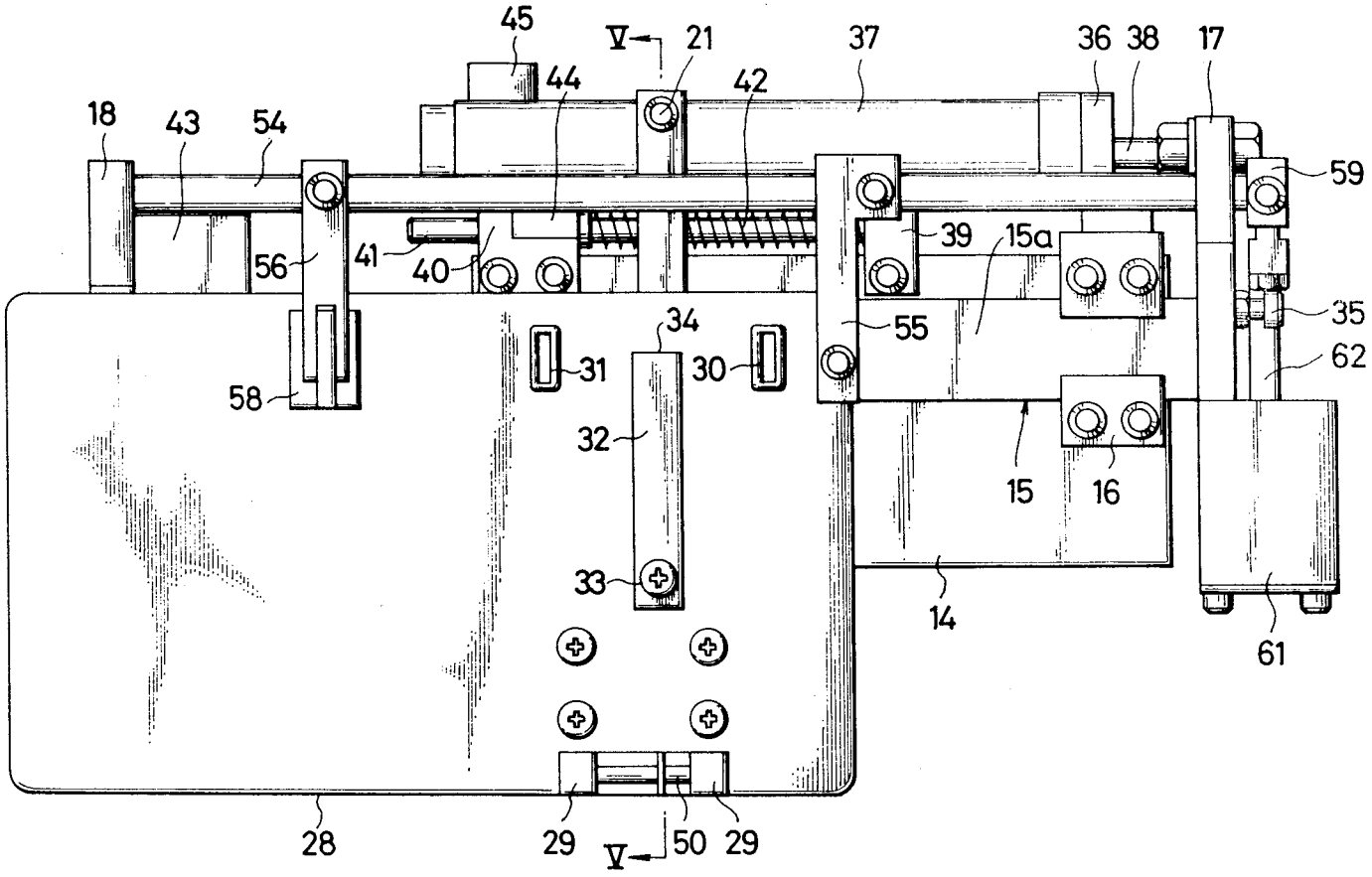
FIG. 2 is a plan view of the apparatus shown in FIG. 1.
Figure 9:
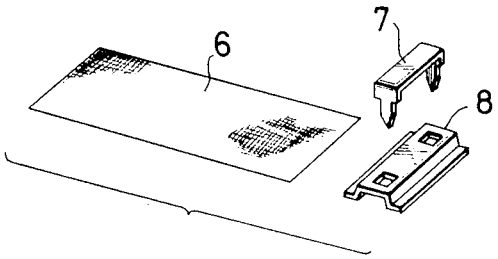
FIG. 9 is a perspective view of a pair of fastener elements and a stay or inner lining to be joined together on an apparatus according to the present invention.

The die plate 28 has a rectangular shape as shown in FIG. 2 and has a front edge around which the trouser body 3 and the lining cloth 5 (both shown in FIG. 10) are supported with the waistband 2 faced upwardly, the front edge of the die plate 28 being disposed in a space defined between upper and lower jaws of the C-shaped frame 12. The die plate 28 has a pair of laterally spaced dies 30, 31 disposed adjacent to the front edge thereof and formed by recesses in an upper surface of the die plate 28 for receiving respectively therein a pair of back plates 8 (FIG. 9). A resilient presser plate 32 formed of an elongate leaf spring is disposed between the dies 30, 31 for resiliently holding the stay 6 (FIG. 9). The presser plate 32 is secured at its rear end to the die plate 28 by a screw 33 and has a front end 34 disposed between the dies 30, 31 and forced against the upper surface of the die plate 28 under the resiliency of the presser plate 32. The number of the dies 30, 31 is not limited to two and three or more dies may be provided.

The die 30 (on the right side in FIG. 2) is positioned beneath the punch 13 (FIG. 1) by a positioning means. The positioning means comprises a third stopper 35 and the second stopper 24 stated above. The third stopper 35 is formed of a bolt threaded to the side plate 17 (on the right side in FIG. 2) and extending in confrontation to a side edge of the table 14. When the stopper bolt 35 engages the side edge of the table 14 and when the stopper bolt 24 engages the rear end face of the transverse slide plate 15, the die 30 is held in vertical alignment with the punch 13.

The die plate 28 is laterally reciprocable in a horizontal plane so that the die 31 on the left side in FIG. 2 can be positioned beneath the punch 13 when the die plate 28 is moved rightwards in the same figure. To this end, a first air cylinder 37 adapted to be operated by a foot switch (not shown) is horizontally supported on a holder plate 36 projecting forwardly from the table 14. The air cylinder 37 extends parallel to the elongate body 15*a* of the transverse slide plate 15 and has a piston rod 38 connected to the side plate 17 (on the right side in FIG. 2) secured to the transverse slide plate 15. A pair of laterally spaced support lugs 39, 40 projects forwardly from the table 14 and slidably supports thereon a cushion rod 41. The cushion rod 41 extends parallel to the air cylinder 37 and is urged by a compression coil spring 42 in a direction opposite to the direction of advancing movement of the piston rod 38 of the air cylinder 37. The cushion rod 41 projects leftwards from the support lug 40 and is engageable with a fourth stopper 43 projecting rightwardly from the side plate 18 secured to the transverse slide plate 15. A first proximity switch 44 is disposed on the support lug 40 for detecting the arrival of the fourth stopper 43 at a predetermined position adjacent to the switch 44. A second proximity switch 45 is disposed on the air cylinder 37 adjacent to a rear end thereof for detecting arrival of a piston (not shown) of the air cylinder 37 at its retracted position.

With this construction, when the air cylinder 37 is activated to extend its piston rod 38 to move the transverse slide plate 15 and the die plate 28 rightwards, the fourth stopper 43 is caused to engage the cushion rod 41 and then force the same rightwards against the bias of the compression coil spring 42. When the stopper 43 is moved into a sensible region of the first proximity switch 44, the switch 44 issues a command signal to de-activate the air cylinder 37 to thereby stop the forward movement of the piston rod 38. In this instance, the die 31 on the left side in FIG. 2 is disposed beneath the punch 13. The command signal also drives the punch 13 downwardly toward the die 31 for attaching the eye member 7 (FIG. 9) to the trouser waistband 2. After the eye member 7 is attached to the trouser waistband 2, the punch 13 is moved upwardly and at the same time the air cylinder 37 is activated again to retract its piston rod 38 whereupon the die plate 28 moves leftwards and returns to its initial position.

After two eye members 7 have been attached to the trouser waistband 2, the trousers 1 are detached from the die plate 28, and then the next pair of trousers is set on the die plate 28. In order to facilitate attachment and detachment operation of the trousers 1, the die plate 28 is retractable outwardly from the space in the C-shaped frame 12 and also pivotable vertically about the pivot pin 27 to tilt into an upwardly tilted position. Such a combined movement of the die plate 28 is achieved by a die-plate displacement mechanism. Two preferred embodiments of the die-plate displacement mechanism will be described below in greater detail.

Figure 3:
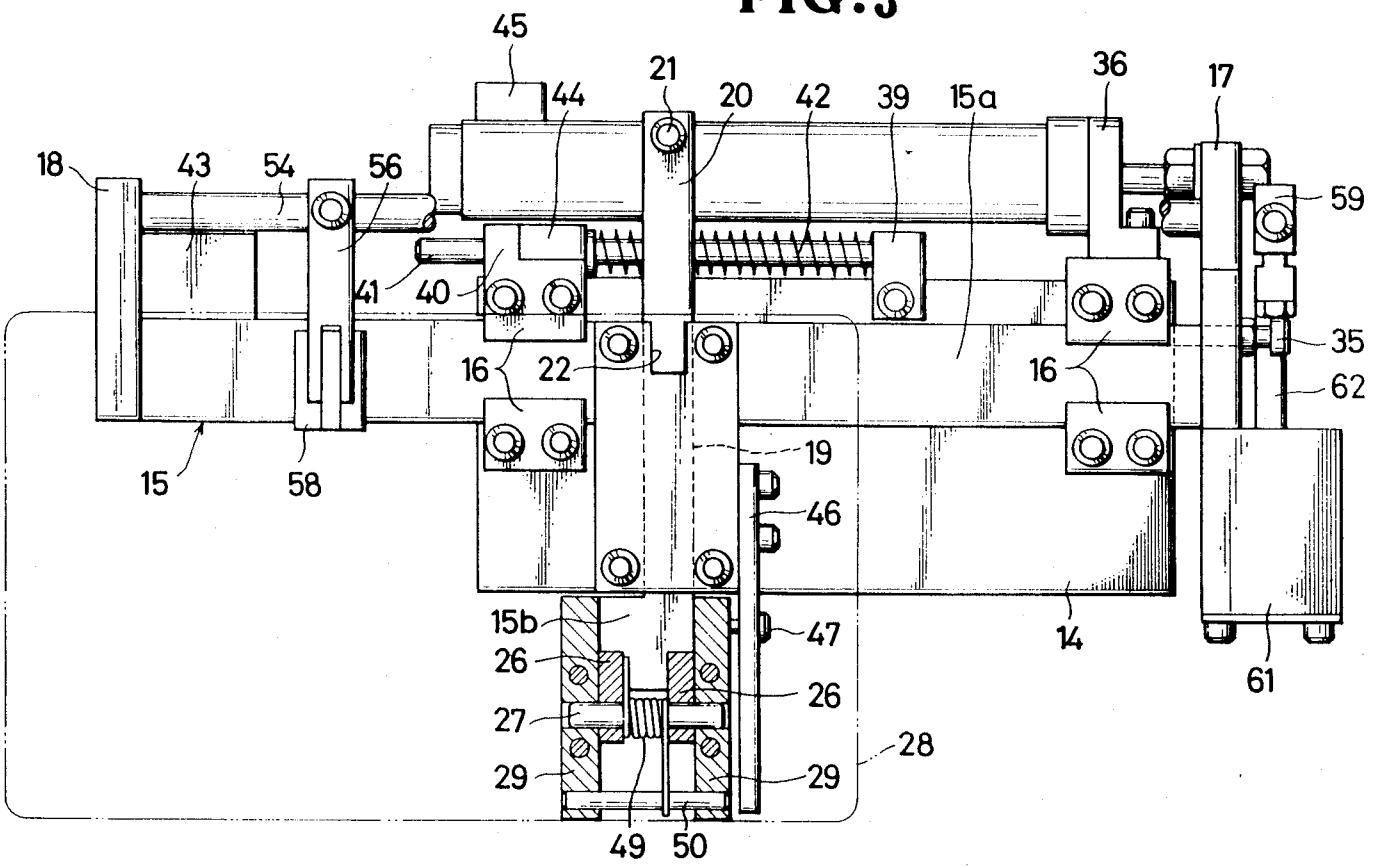
FIG. 3 is a plan view of the apparatus with a die plate omitted for clarity.
Figure 4:
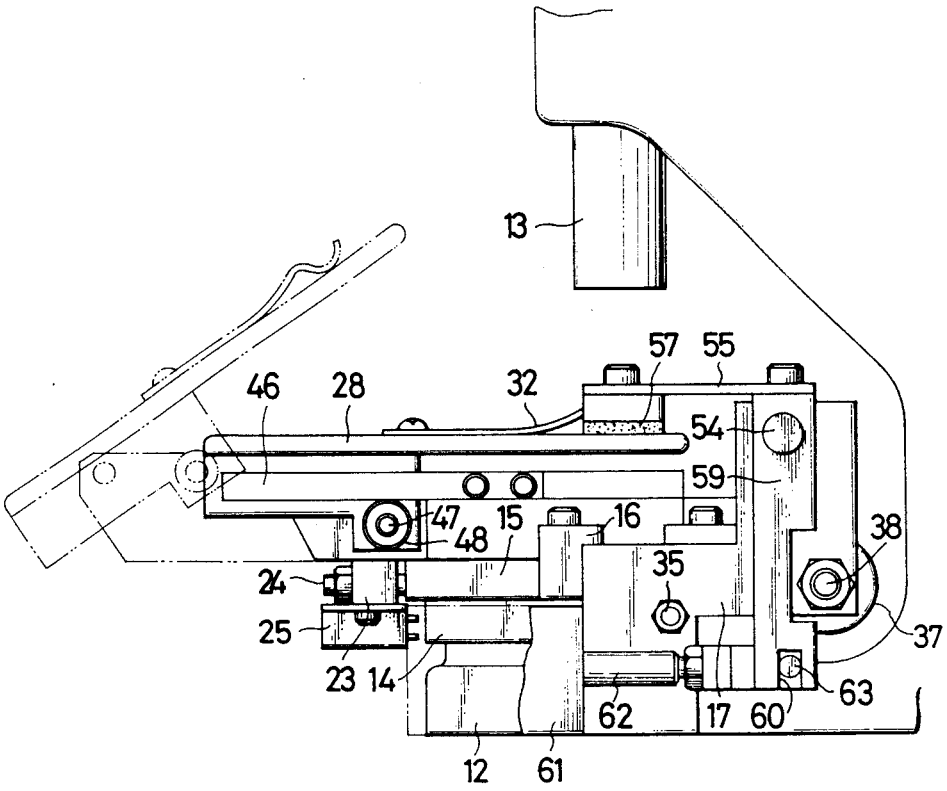
FIG. 4 is a side view of the apparatus shown in FIG. 1.

A first preferred embodiment of the die-plate displacement mechanism includes, as illustrated in FIGS. 3 and 4, an elongate control plate 46 screwed to a side edge of the lateral projection 15*a*, and a roller 48 held in rolling engagement with the underside of the control plate 46. The roller 48 is rotatably mounted on a horizontal support shaft 47 projecting laterally outwardly from one of the brackets 29. The mechanism further includes a helical spring 49 disposed around the pivot pin 27, as shown in FIGS. 3 and 5. The helical spring 49 has one end held in contact with the upper surface of the longitudinal slide plate 20, the opposite end of the helical spring 49 being connected to a support pin 50 rearwardly spaced from the pivot pin 27 and extending horizontally between the bracket 29. With this arrangement, the die plate 28 is urged by the helical spring 49 to turn upwardly about the pivot pin 27. When the die plate 28 is manually pulled rearwardly by the operator until the roller 48 is displaced off from the rear end of the control plate 46, the die plate 28 automatically tilts upwardly under the force of the helical spring 49 into the upwardly tilted position indicated by phantom lines in FIG. 4.

Figure 6:
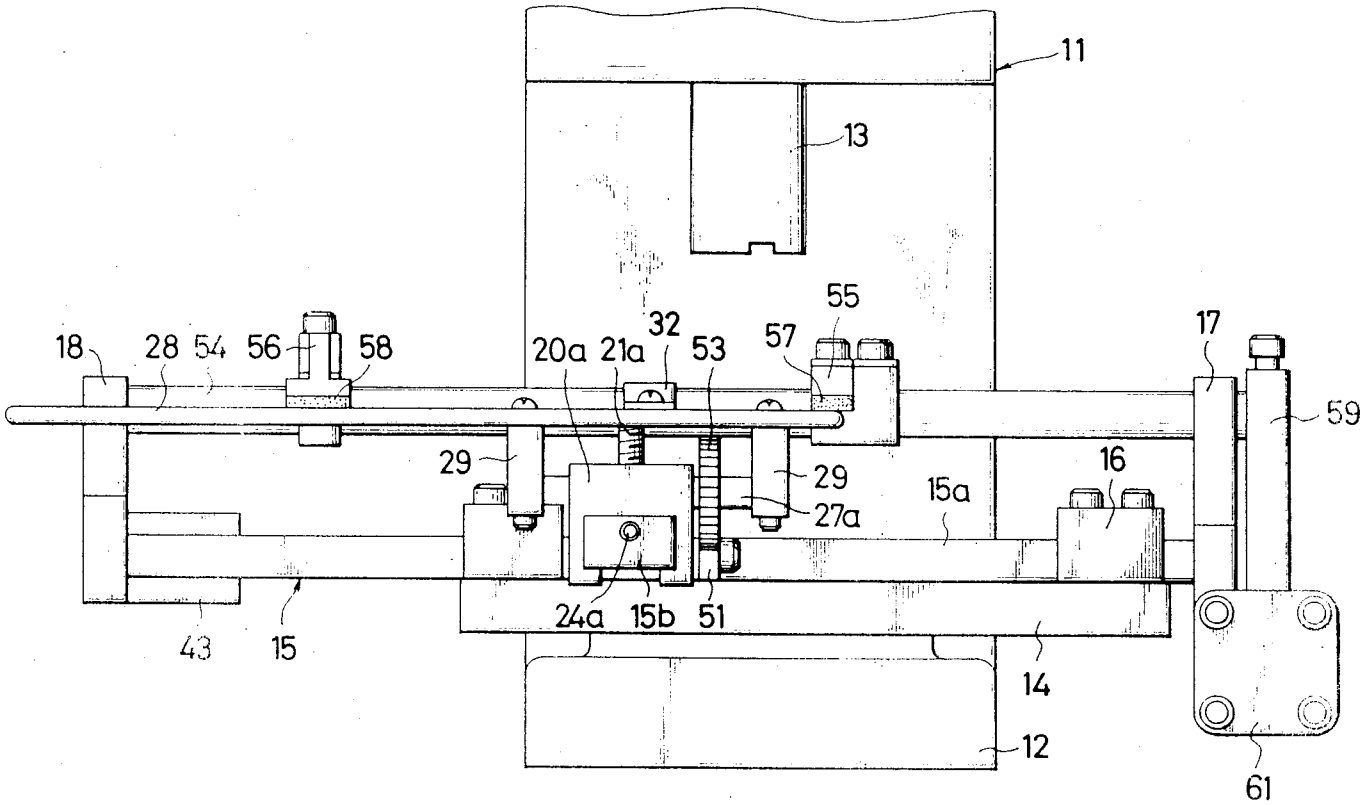
FIG. 6 is a view similar to FIG. 1, but showing a modified apparatus according to the present invention.
Figure 7:
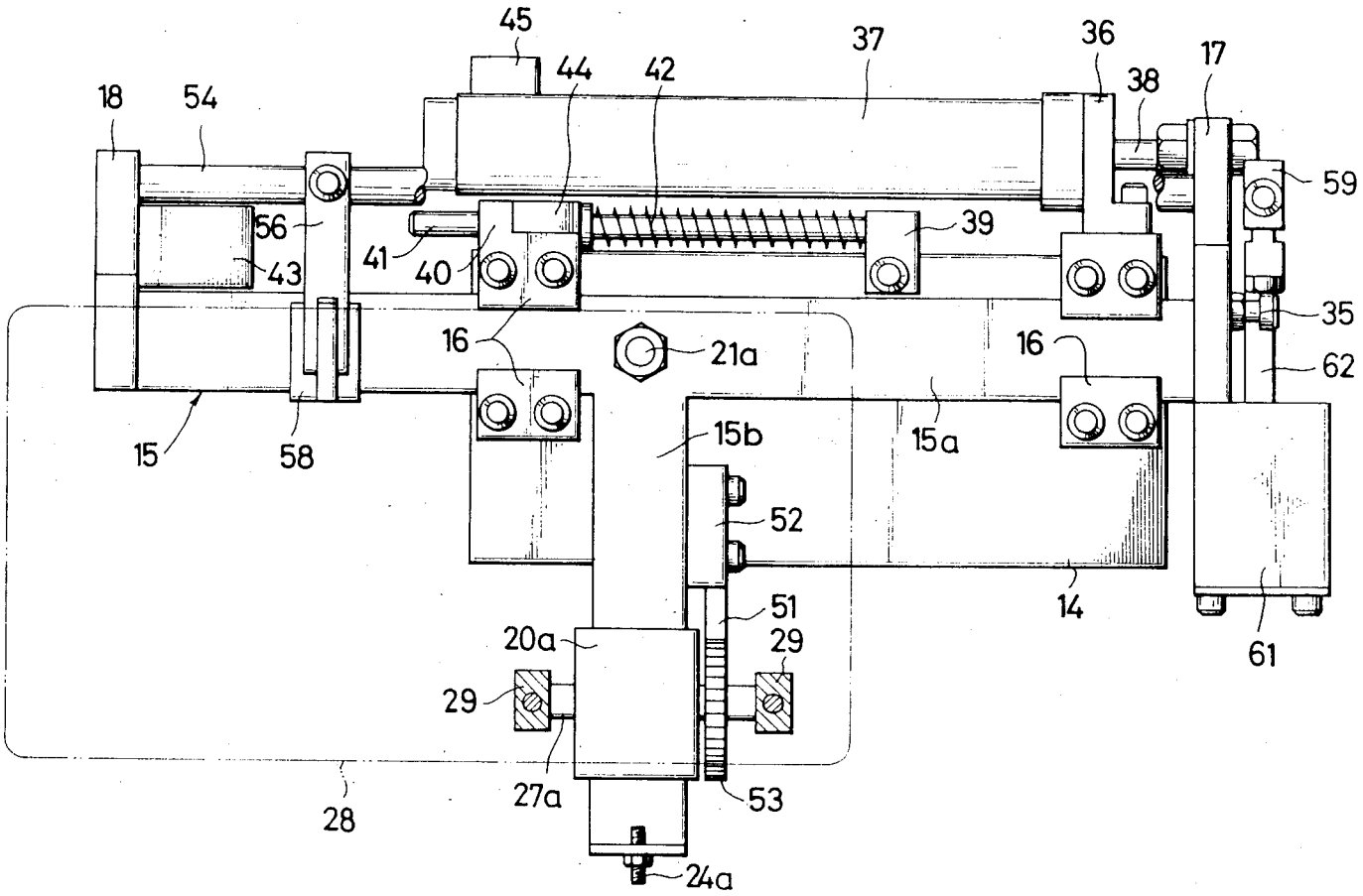
FIG. 7 is a plan view of the modified apparatus with a die plate removed for clarity.
Figure 8:
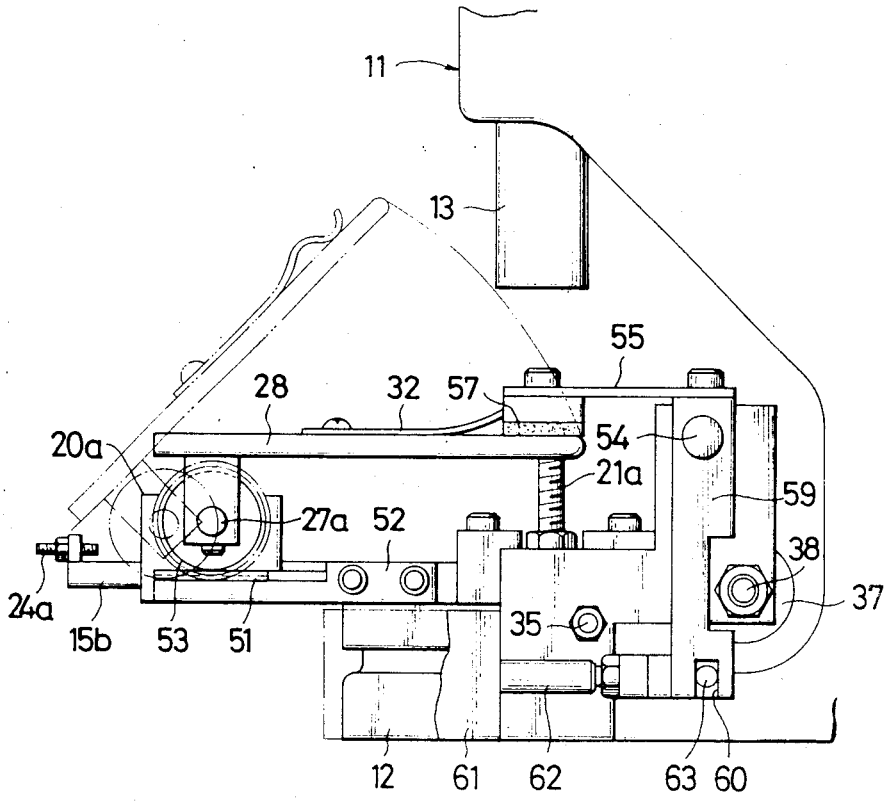
FIG. 8 is a side view of the apparatus shown in FIG. 6.

A second preferred embodiment of the die-plate displacing mechanism is shown in FIGS. 6 through 8. The displacement mechanism includes a toothed horizontal plate 52 having a rack 51 and secured by screws to a side edge of the lateral projection 15*b* of the transverse slide plate 15, and a pinion 53 held in mesh with the rack 51. The pinion 53 is keyed to a pivot pin 27*a* extending through a longitudinal slide block 20*a* in parallel relation to the elongate body 15*a* of the transverse slide plate 15. The pivot pin 27*a* is supported at its opposite ends by the brackets 29, 29 and fastened to the brackets 29 by a pair of lock screws (not designated). The longitudinal slide block 20*a* is slidably mounted astride the lateral projection 15*b* of the transverse slide plate 15. A stud bolt 21*c* constituting a first stopper extends upwardly from an intermediate portion of the elongate body 15*a* adjacent to the proximal end of the lateral projection 15*b*. The stud bolt 21*a* is engageable with the underside of the die plate 28 to limit forward movement of the slide block 20*a* and the die plate 28. A horizontal bolt 24*a* constituting a second stopper is disposed at the rear end of the lateral projection 15*b* and engageable with the rear end of the longitudinal slide block 20*a* to limit rearward movement of the longitudinal slide block 20*a*.

With this construction, when the die plate 28 is pulled rearwardly away from the clenching station beneath the punch 13, the pinion 53 is rotated by the rack 51. Rotation of the pinion 53 causes the die plate 28 to pivot upwardly about the pivot pin 27*a*. Upward pivotal movement of the die plate 28 is terminated when the slide block 20*a* engages the stopper bolt 24*a*. In this instance, the die plate 28 is held in its upwardly tilted position (indicated by phantom lines in FIG. 8) by a balance of the weight. When the die plate 28 and the longitudinal slide block 20*a* are forced to move forwardly, the die plate 28 tilts progressively downwardly. The downward movement of the die plate 28 is terminated when the die plate 28 abuts on the stopper bolt 21*a*. In this instance, the die plate 28 is disposed in a horizontal position.

The apparatus 11 further includes a garment holder for holding a garment (trousers 1 in the illustrated embodiment) during attachment of the eye members 7 to the trouser waistband 2. The garment holder includes, as shown in FIGS. 2 through 4, a pair of pivot arms 55, 56 secured by screws to a horizontal shaft 54 rotatably supported by the side plates 17, 18. The arms 55, 56 are laterally spaced apart and disposed on the outside of the respective dies 30, 31 (FIG. 2). Each of the arms 55, 56 has a presser foot 57, 58 formed of an elastic material such as rubber. When the shaft 54 is turned couterclockwise in FIG. 4, the arms 55, 56 are tilted downwardly to thereby force the presser feet 57, 58 against the upper surface of the die plate 28. The presser foot 57 on the right side in FIG. 1 has a smaller surface area than the presser foot 58 on the left side and hence the presser foot 57 exerts a greater pressure on the die plate 28 than the presser foot 58.

The horizontal shaft 54 is oscillated by a second air cylinder 61 which is secured to the side plate 17 of the transverse slide plate 15 and extends in a direction perpendicular to the axis of the horizontal shaft 54. As shown in FIG. 4, a piston rod 62 of the air cylinder 61 has a horizontal pin 63 projecting laterally outwardly therefrom and fitted in a downwardly open cutout recess 60 in a lever 59 screwed to an end of the horizontal shaft 54. In FIG. 4, the air cylinder 61 is shown in a first activated condition in which the piston rod 62 is fully extended to thereby force the presser feet 57, 58 against the upper surface of the die plate 28. When the presser feet 57, 58 are to be disengaged from the die plate 28, the air cylinder 61 is activated to retract its piston rod 62 to turn the lever 59 clockwise in FIG. 4, thereby causing the arms 55, 56 to turn in the same direction about the shaft 54.

Though not shown, the apparatus 11 is provided with a part feeder mechanism for supplying eye members 7 one at a time to the punch 13. The parts feeder mechanism is conventional in construction and does not constitute a main part of the present invention and hence a description is not necessary.

In the apparatus 11 of the foregoing construction, the die plate 28 is slidably movable in a lateral direction of the apparatus 11 for attaching two eye members 7 successively one at a time to the trouser waistband 2. After attachment of the eye members 7 is completed, the die plate 28 is retracted rearwardly away from the clenching station defined beneath the punch 13 so that the die plate 28 can readily receive a trouser body 3 with greater working space available for manipulation of the material. The die plate 28 may be displaced away from the clenching station in a lateral direction of the apparatus 11.

The apparatus 11 of the foregoing construction operates as follows. The operation of the apparatus 11 begins with the first and second air cylinders 37, 61 held in contracted condition and with the die plate 28 held i its upwardly tilted position indicated by phantom lines in FIGS. 4 or FIG. 8. After two back plates 8 are set in the respective dies 30, 31, a stay 6 is resiliently held on the die plate 28 by the presser plate 32 such that the stay 6 overlies the back plates 8. Then a pair of trousers is set on the die plate 28 in such a manner that the front edge of the die plate 28 is embraced by the trouser body 3 and the lining cloth 5 with the waistband 2 facing upwardly. Thereafter, the die plate 28 is forced to move forwardly toward the clenching station until its forward movement is limited by the first stopper 21 or 21*a*. During that time, the die plate 28 is gradually tilted down toward a horizontal position. When the forward movement of the die plate 28 is limited, the first die 30 (on the right side in FIG. 1) is disposed in vertical alignment with the punch 13. Then the second air cylinder 61 is activated to extend its piston rod 62 to tilt the arms 55, 56 downwardly toward the die plate 28, thereby forcing the material of the trousers 1 against upper surface of the die plate 26 by means of the presser feet 57, 58. Thereafter, the punch 13 to which an eye member 7 has been supplied is descended toward the die 30 to thereby join or clench the eye member 7 and the back plate 8 with the waistband 2 and the stay 6 firmly gripped between the eye member 7 and the back plate 8. Then the first air cylinder 37 is activated to extend its piston rod 38 to move the die plate 28 rightwards in FIG. 2 until arrival of the fourth stopper at a predetermined position is detected by the proximity switch 44. When the rightward movement of the die plate 28 is terminated, the second die 31 on the left side in FIG. 2 is disposed beneath the punch 13. Substantially at the same time, the punch 13 is driven to descend toward the die 31 so that another eye member 7 is clenched with the back plate 8 with the waistband 2 and the stay 6 firmly gripped between the eye member 7 and the back plate 8. Thereafter, the first air cylinder 37 is activated again to retract its piston rod 38 to move the die plate 28 leftwards to the position shown in FIG. 2. The second air cylinder 61 is activated again to contract its piston rod 62 to detach the presser feet 57, 58 from the material of the trousers 1. Then the die plate 28 is pulled rearwardly away from the frame 12, whereupon the die plate 28 tilts upwardly. As a result, a large space is available around the die plate 28 for detachment of the trousers 1 from the die plate 28.

As described above, the fastener attaching apparatus of the present invention includes a die plate disposed below a vertically movable punch and having at least two dies spaced apart in a first direction. The die plate is slidably movable in the first direction for placing the dies successively into alignment with the punch so that the fastener elements (eye members for hook-and-eye fasteners in the illustrated embodiments) are attached one at a time to a garment. With this slidable die plate, the fastener-element attachment operation can be effected accurately and reliable without causing a substantial reduction of efficiency.

Since the die plate is retracted in a second direction away from the punch in a plane of sliding movement of the die plate, it is possible to set the manipulating position at an adequate level. The die disposed in its retracted position remote from the punch is tiltable upwardly so that the garment can easily be attached to and detached from the die plate. The apparatus has a relatively small number of components and hence is simple in construction and compact in size.

The direction in which the die plate is displaced away from the punch is perpendicular to the first direction in which the dies are spaced apart. The die plate tilts upwardly as it is displaced away from the punch. With this construction, the garment can be set on and detached from the die plate with utmost ease.

Obviously, various modifications and variations of the present invention are possible in the light of the above teaching. It is therefore to be understood that within the scope of the appended claims the invention may be practiced otherwise than as specifically described.

What is claimed is:

1. An apparatus for attaching fastener elements one at a time to a garment, comprising:

(a) vertically movable punch; and (b) a die plate disposed below said punch and having a plurality of dies spaced apart in a first direction, said die plate being slidably movable in said first direction to place said dies successively into alignment with said punch, said die plate being displaceable in a second direction away from said punch in a plane of sliding movement of said die plate, said second direction being perpendicular to said first direction, said ie plate being pivotally movable about an axis parallel with said first direction plane when it is disposed in a position remote from said punch, said die plate being tiltable upwardly as it is displaced in said second direction away from said punch.

2. An apparatus according to claim 1, further including a generally C-shaped frame having an upper part supporting thereon said punch and a lower part confronting said upper part, a table mounted on said lower part of said frame, a first slide member slidably mounted on an upper surface of said table and movable in said first direction which is a lateral direction of said frame, a second slide member slidably mounted on said first slide member and movable in said second direction, said die plate being pivotally connected to said second slide member and extending over said second slide member, means defining opposite end extremities of sliding movement of said second slide member, and means for causing said die plate to pivot in said vertical plane when said second slide member reciprocates between said opposite end extremities of its sliding movement.

3. An apparatus according to claim 2, said means for causing said die plate to pivot comprising an elongate control plate secured to said first slide member and extending in said second direction, a roller rotatably mounted on said die plate and rollingly engageable with the underside of said control plate, said roller being displaced off said control plate when said second slide member is disposed at one of said end extremities of its sliding movement remote from said punch, and a spring acting between said second slide member and said die plate and urging the latter to tilt upwardly away from said second slide member.

4. An apparatus according to claim 2, said means for causing said die plate to pivot comprising a rack secured to said first slide member and extending in said second direction, a pivot pin secured to said die plate and pivotally connecting said die plate and said second slide member, and a pinion mounted on said pivot pin for co-rotation therewith and held in mesh with said rack.

5. An apparatus for attaching fastener elements one at a time to a garment, comprising:

(a) vertically movable punch;

(b) a die plate disposed below said punch and having a plurality of dies spaced apart in a first direction, said die plate being slidably movable in said first direction to place said dies successively is not alignment with said punch, said die plate being displaceable in a second direction away from said punch in a plane of sliding movement of said die plate, said die plate being pivotally movable about an axis parallel with said first direction when it is disposed in a position remote from said punch; and (c) a shaft rotatably supported on said die plate and extending in said first direction, at least two parallel spaced arms secured to said shaft and having presser feet engageable with an upper surface of said die plate, and an actuator operatively connected with said shaft for oscillating said shaft to move said presser feet toward and away from said upper surface of said die plate.

6. An apparatus according to claim 5 said presser feet being formed of an elastic material.

7. An apparatus for attaching fastener elements one at a time to a garment, comprising:

(a) vertically movable punch;

(b) a die plate disposed below said punch and having a plurality of dies spaced apart in a first direction said die plate being slidably movable in said first direction to place said dies successively into alignment with said punch, said die plate being displaceable in a second direction away from said punch in a plane of sliding movement of said die plate, said die plate being pivotally movable about an axis parallel with said first direction when it is disposed in a position remote from said punch; and (c) a resilient presser plate disposed on an upper surface of said die plate and secured at one end to said die plate, said resilient presser plate having an opposite end disposed between two adjacent ones of said dies and urged against said upper surface of said die plate under the resiliency of said presser plate.

* * * * *